US006402581B1

(12) United States Patent
Podgaiz

(10) Patent No.: US 6,402,581 B1
(45) Date of Patent: Jun. 11, 2002

(54) BUILDING TOY

(75) Inventor: Ricardo Hugo Podgaiz, Buenos Aires (AR)

(73) Assignee: Graciela Carmen Abuin, Buenos Aires (AR)

( * ) Notice: Subject to any disclaimer, the term of this patent is extended or adjusted under 35 U.S.C. 154(b) by 0 days.

(21) Appl. No.: 09/698,538

(22) Filed: Oct. 27, 2000

(51) Int. Cl.[7] ..... A63H 33/04

(52) U.S. Cl. ..... 446/107; 403/174; 403/217; 403/286

(58) Field of Search ..... 285/133.11, 133.3, 285/179, 382; 403/174, 178, 205, 217, 286, 287; 446/85, 89, 107, 111

(56) References Cited

U.S. PATENT DOCUMENTS 1,770,852 A * 7/1930 Hill
2,425,817 A * 8/1947 Mosca
2,735,699 A * 2/1956 Chadbourne
2,746,769 A * 5/1956 Hoogendoorn
3,645,569 A * 2/1972 Reilly
3,830,011 A * 8/1974 Ochrymowich
4,952,092 A * 8/1990 Ballerstein
5,049,105 A * 9/1991 Glickman

* cited by examiner

*Primary Examiner*—John A. Ricci
(74) *Attorney, Agent, or Firm*—Darby & Darby

(57) ABSTRACT

A building toy comprising a plurality of flexible and stiff pieces and connectors capable of being connected to each other in a desired pattern to form constructions like buildings, cars, forts, planes and other recreation arrangements, the toy comprising a plurality of flexible hollow tubes connectable to each other by means of connectors than can be snugly fitted into the hollow ends of the tubes.

20 Claims, 2 Drawing Sheets

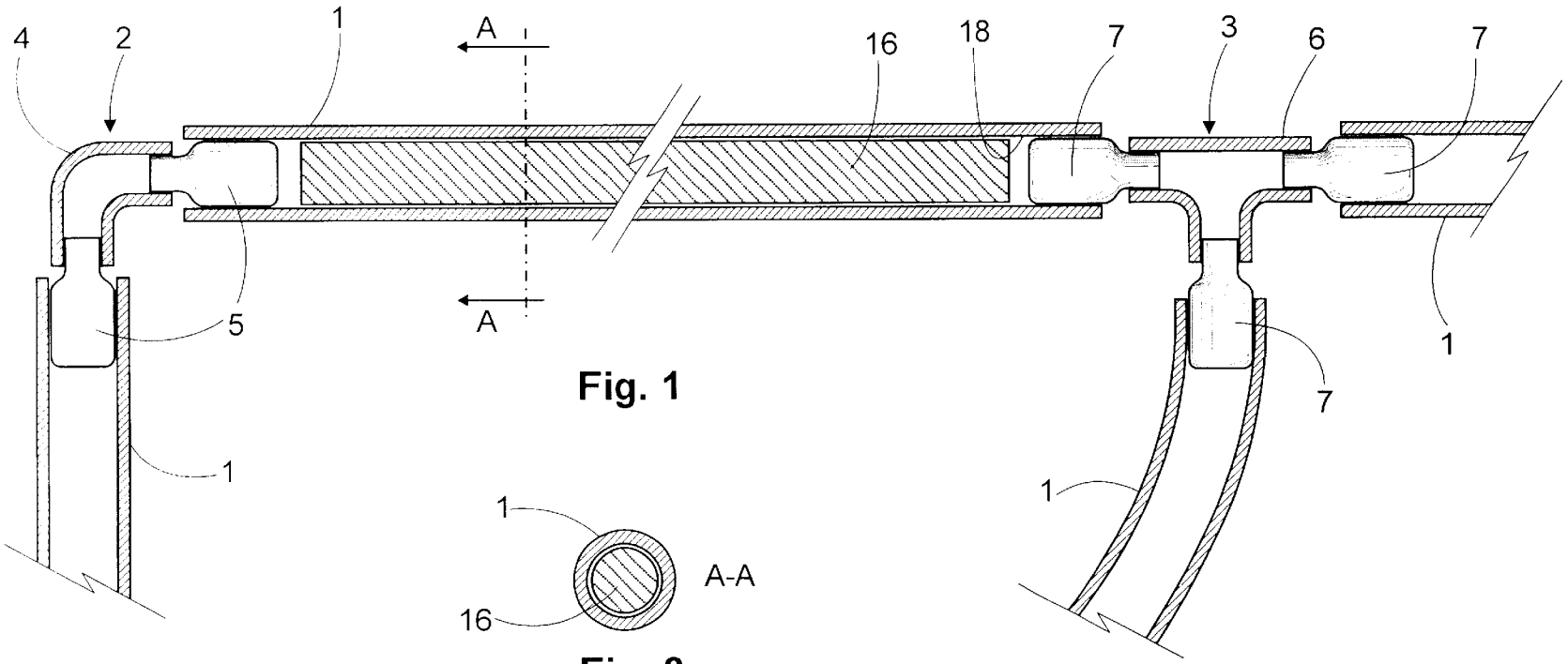
Fig. 1
Fig. 2
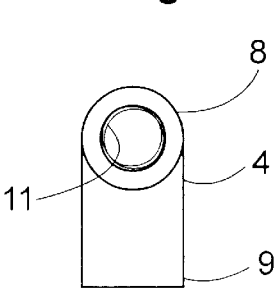
Fig. 4
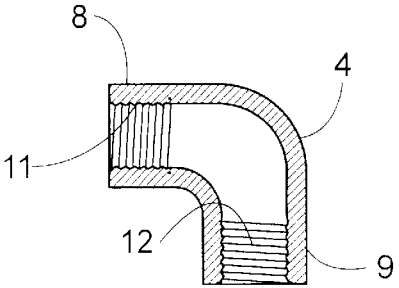
Fig. 3
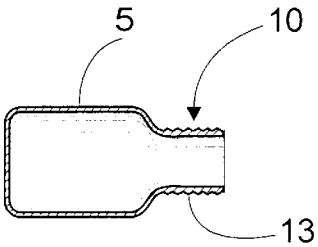
Fig. 5
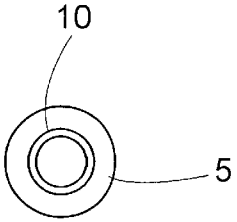
Fig. 6

BUILDING TOY

BACKGROUND OF THE INVENTION

1. Field of the Invention

The present invention relates to the field of recreation for children and even adults and, more particularly, the invention refers to a building toy comprising a plurality of building pieces and connectors for connecting the pieces to each other and forming flexible constructions and structures, either plane or tridimensional structures, for making up houses, towers, bridges, cars, vehicles, planes, helicopters, and any other kind of constructions, preferably toy constructions.

To the purpose of the present specification the term "flexible", when used for the hollow tubular pieces or tubes of the toy, must be understood as that the tubes are capable of being easily curved either maintaining its curved status or with elastic memory to return to its original configuration under relaxed condition.

2. Description of the Prior Art

It is well known to provide several types of building toys comprising modular pieces. These toy may be classified in several categories such as for example:

The classical toy know as "meccano" comprised of a set of pieces having several shapes, such as plane pieces, angled pieces or a combination of both, generally manufactured as metal plates with a plurality of orifices for receiving screws to connect the pieces to each other and make up houses, mechanical assemblies, bridges, towers and machines in general, etc. More precisely, the connections are carried out by means of screws, nuts and washers and several other fittings and accessories are provided, such as wheels, shafts, pulleys, etc. capable of being connected to each other and to the remaining pieces by using auxiliary pieces and members.

There are also known systems based in modular elements, similar to small bricks or blocks, capable of being fitted one into the other under a slight pressure in order to obtain constructions of several designs, generally cubic or house-like constructions. These toys usually are provided with a plurality of auxiliary pieces such as plates, roofs, windows, such as the one manufactured under the trademark "LEGO". Other toys that can be included within this type are those comprising a plurality of cylindrical bar having several lengths and provided with grooves and notches at their ends whereby the bars can be connected to each other by snugly interconnecting the grooves thereof to form houses, towers, bridges, etc.

Another kind of construction toy is the typical set of pieces for assembling mini models of ships, cars, planes, animals, trains, etc. wherein the pieces are each designed to form a part of the construction at a desired scale and the pieces must be assembled to each other by using an adhesive. In these toys, the pieces are precise reproductions in miniature of the corresponding parts or elements of the construction to be obtained. These toys, once assembled, generally remains permanently assembled and can not be disassembled because the constituent pieces are not detachable.

Other construction systems are designed to make up only one predetermined construction. Differing from the above model system, this system comprises a plurality of pieces that can be assembled and disassembled, with each piece having a specific design to match with the other pieces and can occupy only one position in the construction in order to make up the predetermined design of car, house or plane, for example. The pieces can mesh or fit together directly or by means of connectors, and can be interconnected by pressure or threading. This kind of building toy is commercially available under the trademark "FAVRE".

While the above building toys have provided, even during the last decades, a number of possibilities of constructing several designs in constructions, the same are affected by several limitations.

The above mentioned "Meccano" building toy is limited to very small construction because its constituent pieces, rigid and stiff, either made of metal or wood, would be very heavy if manufactured with larger sizes thus causing the toy being unable of being manipulated by a child. In addition, the small constituent pieces and accessories, like screws, nuts and washers, are dangerous for small kids.

The building toys comprised of very small blocks or bricks are also restricted to small constructions and are affected by the same safety drawbacks like the above system. If one desires to make a larger construction an extremely high number of pieces should by used, otherwise, to count on a reasonable number of pieces, the pieces must be of a larger size and the weight of the entire set of pieces and the final construction would be inconvenient for the manipulation by a kid. Also, with such larger sizes, much more force would be required for a kid to fit each brick into the other.

A child using a building toy for obtaining models are only able to make a predetermined construction, such as a ship, a plane, etc. without allowing the children to put their creativity in practice.

It would be therefore convenient to have a building system that is light, flexible, that allows a kid to make up even a large construction such a house capable of receiving the child thereinto, and capable of being assembled and disassembled, only restricted to the child creativity.

SUMMARY OF THE INVENTION

It is therefore one object of the present invention to provide a building toy comprising a plurality of building pieces and connectors for connecting the pieces to each other and forming flexible constructions and structures, either plane or tridimensional structures, for making up houses, towers, bridges, cars, vehicles, planes, helicopters, and any other kind of constructions, preferably toy constructions larger than the typical toy constructions, the inventive toy being light and flexible to be easily manipulated by children, promoting the children's creativity to design the desired construction, only requiring a minimum skillfulness for manipulating and connecting the tubes.

It is still another object of the present invention to provide a building toy comprising a plurality of flexible and stiff pieces and connectors capable of being connected to each other in a desired pattern to form constructions like buildings, cars, forts, planes and other recreation arrangements, the toy comprising a plurality of flexible hollow tubes connectable to each other by means of connectors than can be snugly fitted into the hollow ends of the tubes only applying a slight pressure.

It is a further object of the present invention to provide a building toy comprising a set of pieces and connectors for matching and connecting into desired constructions, the toy comprising a plurality of hollow tubes made of a resilient flexible material, a plurality of connectors, each connector comprising a connecting node and at least two connecting pegs, each peg for fitting into an end of respective hollow tubes, whereby the plurality of tubes can be connected to each other to form the desired construction.

It is a further object of the present invention to provide a building toy for making up large volume constructions and structures, forming reticular spatial structures, capable of being curved and deformed, for obtaining straight and linear structures or curved structures, the toy comprising a plurality of flexible hollow tubes that can be stiffened by stiff bars in order to combine curved tubes and straight stiff tubes.

The above and other objects, features and advantages of this invention will be better understood when taken in connection with the accompanying drawings and description.

BRIEF DESCRIPTION OF THE DRAWINGS

The present invention is illustrated by way of example in the following drawings wherein:

FIG. 1 shows a partially cross-sectional view of a structure or construction made several hollow tubes, one containing a stiff bar, and connectors;

FIG. 2 shows a cross-sectional view taken along line A—A of FIG. 1, the tube containing a stiff bar according to another embodiment of the invention;

FIG. 3 shows a cross-sectional view of a connecting node according to an embodiment of the invention;

FIG. 4 shows an elevational view taken from a connection end of the node of FIG. 3;

FIG. 5 shows a cross-sectional view of a peg according to an embodiment of the invention;

FIG. 6 shows an elevational view taken from a connection portion of the node of FIG. 5;

DESCRIPTION OF THE PREFERRED EMBODIMENTS

Figure 7:
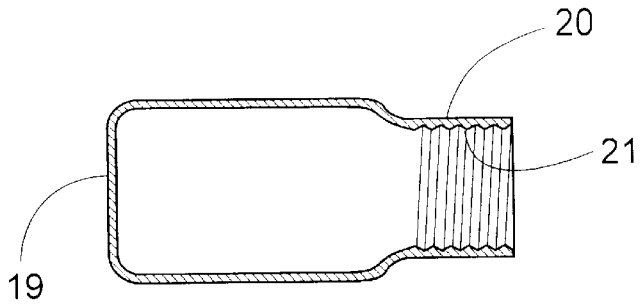
FIG. 7 shows a cross-sectional view of a peg according to another embodiment of the invention.

Now referring in detail to the drawings it may be seen from FIG. 1 that the building toy of the invention comprises a plurality of hollow tubular pieces, named tubes 1, generally straight tubes, made of a resilient flexible material, such as a plastic foam, an elastomeric foam, plastics, rubber. If the tubes are made of a foamed material the same may have an inner or an outer no-foamed skin surface or may be recovered with a different material. The material from which the tubes are manufactured provides the tubes with the necessary lightness, flexibility and resiliency to deform the tubes as desired, either temporarily or permanently. In other words, the tubes may be shaped into curves and may maintain the curve in relaxed condition, or may have elastic memory to recover its original form once in relaxed condition. If the tube is deformed into a plastic deformation, the tube should be capable of recovering its original shape by either applying a force contrary to that one producing the deformation or just through its resilient memory. When foamed material is used for the tubes, the assembly is ultra-light.

The toy also comprises a plurality of connectors such as elbow-type connectors 2, T-shape connectors 3, linear straight connectors like the upper branch of connector 3, or any other kind of plane or spatial connector, for example, 45°, 90°, 30° angled connectors, Y-shape connectors, X-shape connectors, double-cross spatial connectors, etc. Each connector, for example elbow connector 2, comprises a node 4 and at least two connecting pegs 5. T-type connector 3 comprises a T-shape hollow node 6 with three pegs 7. Each peg fits into an end of a respective hollow tube, whereby the plurality of tubes can be connected to each other to form the desired construction. Each tube has an inner diameter and the peg has an outer diameter conformed to the inner diameter of the hollow tubes whereby the peg can be inserted into the respective tube under a certain pressure to snugly fit into the tube and remain retained into the tube.

Nodes 2, 3, may be hollow or solid bodies, and are preferably hollow pieces having two or more connection ends for receiving the respective pegs. Nodes are made of stiff, semi-stiff or resilient material, such as plastics and foams, like the tubes material, for example. According to one of the embodiments of the invention, as illustrated in FIGS. 3–6, connecting node 4 comprises an elbow tubular body with two connection ends 8, 9 at 90° relative to each other, each end receiving a connection portion 10 of peg 5 and forming a threaded connection. The threaded connection comprises an inner thread 11, 12 in each connection end 8, 9 of the node and an outer thread 13 in the connection portion of peg 5.

With the above tubes and connectors the toy provides a wide variety of construction designs, all using the same kind of pieces and connectors. Different materials may be used for manufacturing the nodes and the pegs according to the functional requirements of each of these parts. While the nodes can be made of any material, it is preferred that the same are made of non-deformable and light materials to provide the final construction with stability and lightness. The pegs can be made of plastic thin-walled hollow bodies, or of solid plastics, solid foamed plastics or low density foams or elastomers. It is preferred that the material of the pegs is slightly deformable to snugly fit into the tubes, relatively soft to avoid any damage to the tubes material and light.

Since the tubes are made preferably of foamed materials, the same are easily deformable in order to give them any desired shape, such as curves, but it may be desirable that, for a predetermined part of a construction, some tubes are capable of maintaining a straight stiff shape. Therefore, stiff bars 16 are provided to insert them into the desired tubes, whereby some desired flexible resilient tubes may be provided with stiffness in order to form a construction with curved tubes and straight stiff tubes. The stiff bars are preferably shorter than the hollow tubes, whereby a bar can be received within a respective tube with ends 17, 18 of the tube being clear to receive respective pegs 5, 7 for establishing a construction connection. More preferably, the outer diameter of the stiff bars are equal, or slightly smaller or larger than the inner diameter of the tubes. Bars 16 can be made of any stiff or semi-stiff material such as a plastic, a solid low density stiff foamed material. In any case the stiffness of bars 16 should be higher than the stiffness of tubes 1. Stiff bars 16 will provide the construction or structure with a desired stability when necessary and desired.

Tubes 1 may be provided with several lengths depending of the kind of construction that is desired to make. Bars 16 will also be provided in several lengths according to the tubes.

Figure 8:
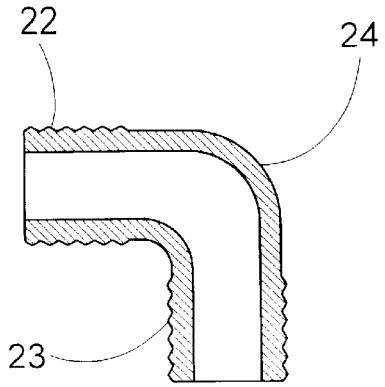
FIG. 8 shows a cross-sectional view of a connecting node according to another embodiment of the invention, for connecting to the peg of FIG. 7.

According to another embodiment of the invention, the connector, as illustrated in FIGS. 7 and 8, comprises a hollow peg 19 with a connection portion 20 including an inner thread 21 for threadably connecting to an outer thread 22, 23, of a connecting node 24. Outer thread 22, 23 is a male thread while inner thread 21 is a female thread.

Figure 9:
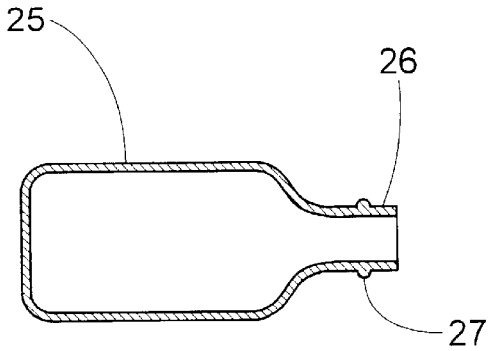
FIG. 9 shows a cross-sectional view of a peg according to a further embodiment of the invention.
Figure 10:
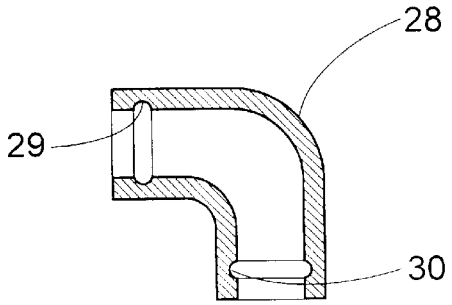
FIG. 10 shows a cross-sectional view of a connecting node according to a further embodiment of the invention, for connecting to the peg of FIG. 9.

Even according to another embodiment of the invention, the connector of FIGS. 9 and 10 comprises a snap connection between the peg and the connecting node. Peg 25 comprises a connection portion 26 provided with an annular rib 27 and node 28 is provided at each connection end with an inner annular groove 29, 30, whereby the connection portion of peg 25 may be inserted with a slight pressure into the corresponding connection end of node 28 until rib 27 snaps into groove 29 or 30 and the peg and node are retained together.

Figure 11:
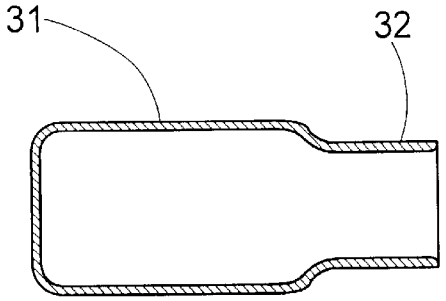
FIG. 11 shows a cross-sectional view of a peg according to a further embodiment of the invention.
Figure 12:
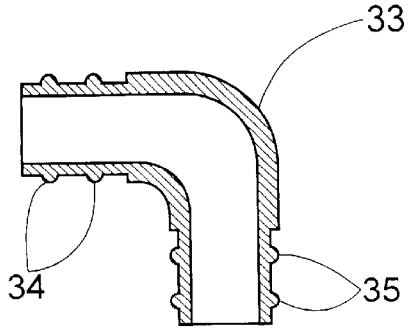
FIG. 12 shows a cross-sectional view of a connecting node according to a further embodiment of the invention, for connecting to the peg of FIG. 11.

FIGS. 11 and 12 show another embodiment of the connector used in the present invention, wherein peg 31 is provided with a smooth connection portion 32 and node 33 has opposite connection ends with a reduced outer diameter, each end including at least two outer annular ribs 34, 35. Thus, peg 31 may be connected to node 33 under a slight pressure by inserting the corresponding connection end of node 33 into connection portion 32 of the hollow peg 31. The peg and the node will be connected by a snugly fitting connection as long as the outer diameter of ribs 34, 35 will snugly fit into the tubular connection portion of the peg.

While preferred embodiments of the present invention have been illustrated and described, it will be obvious to those skilled in the art that various changes and modifications may be made therein without departing from the scope of the invention as defined in the appended claims.

I claim:

1. A building toy comprising a set of pieces and connectors for matching and connecting into desired constructions, the toy comprising:

a plurality of hollow tubes made of a resilient flexible material, a plurality of connectors, each connector comprising a connecting node having at least two connection ends and at least two connecting pegs, each peg for fitting into an end of a respective hollow tube, and wherein each connection end of a connecting node is adapted to receive a connection portion of a peg, whereby the plurality of tubes can be connected to each other to form the desired construction.

2. The building toy of claim 1, wherein each tube has an inner diameter and the peg has an outer diameter conformed to the inner diameter of the hollow tubes whereby the peg can be inserted into the respective tube under a certain pressure to snugly fit into the tube and remain retained into the tube.

3. The building toy of claim 1, wherein the pegs are aligned to connect respective tubes forming a linear construction.

4. The building toy of claim 1, wherein the pegs are angled relative to each other to form angular and/or spatial constructions.

5. The building toy of claim 1, wherein the connection end of the node is connected to the connection portion of the peg by a threaded connection.

6. The building toy of claim 5, wherein the threaded connection comprises an inner thread in the connection end of the node and an outer thread in the connection portion of the peg.

7. The building toy of claim 5, wherein the connection portion of the peg is tubular and the threaded connection comprises an outer thread in the connection end of the node and an inner thread in the connection portion of the peg.

8. The building toy of claim 1, wherein the connection end of the node is connected to the connection portion of the peg by a snap connection.

9. The building toy of claim 8, wherein the snap connection comprises an inner annular groove in the connection end of the node and an outer annular rib in the connection portion of the peg, whereby the rib is snugly fitted into the grove to retain the peg into the node.

10. The building toy of claim 1, wherein the connection end of the node is connected to the connection portion of the peg by a snugly fitting connection.

11. The building toy of claim 10, wherein the connection portion of the peg is tubular and the snugly fitting connection comprises at least two outer annular ribs in the connection end of the node, the ribs being snugly fitted into the tubular connection portion of the peg.

12. The building toy of claim 1, wherein each peg comprises a hollow body.

13. The building toy of claim 1, wherein each hollow tube is made of plastics.

14. The building toy of claim 1, wherein each hollow tube is made of elastomeric foam.

15. A building toy comprising a set of pieces and connectors for matching and connecting into desired constructions, the toy comprising:

a plurality of hollow tubes made of a resilient flexible material, a plurality of connectors, each connector comprising a connecting node and at least two connecting pegs, each peg for fitting into an end of a respective hollow tube, whereby the plurality of tubes can be connected to each other to form the desired construction, and a plurality of stiff bars for inserting into desired ones of said hollow tubes, whereby some desired flexible resilient tubes may be provided with stiffness in order to form a construction with curved tubes and straight stiff tubes.

16. The building toy of claim 15, wherein the stiff bars are shorter than the hollow tubes, whereby a bar can be received within a respective tube with the ends of the tube being clear to receive respective pegs for establishing a construction connection.

17. The building toy of claim 15, wherein the stiff bars has an outer diameter equal to an inner diameter of the tubes.

18. The building toy of claim 15, wherein the stiff bars are shorter than the hollow tubes, whereby a bar can be received within a respective tube with the ends of the tube being clear to receive respective pegs for establishing a construction connection.

19. The building toy of claim 15, wherein the stiff bars has an outer diameter equal to an inner diameter of the tubes.

20. The building toy of claim 15, wherein each connecting node comprises a hollow piece with at least two connection ends, each connection end receiving a connection portion of a respective peg.

* * * * *